US008681943B2

(12) United States Patent
Hertz et al.

(10) Patent No.: US 8,681,943 B2
(45) Date of Patent: Mar. 25, 2014

(54) X-RAY WINDOW

(75) Inventors: Hans Hertz, Stocksund (SE); Oscar Hemberg, Stockholm (SE); Tomi Tuohimaa, Stockholm (SE); Mikaél Otendal, Stockholm (SE)

(73) Assignee: Excillum AB, Kista (SE)

( * ) Notice: Subject to any disclaimer, the term of this patent is extended or adjusted under 35 U.S.C. 154(b) by 306 days.

(21) Appl. No.: 13/144,883

(22) PCT Filed: Jan. 26, 2009

(86) PCT No.: PCT/EP2009/000481
§ 371 (c)(1),
(2), (4) Date: Aug. 26, 2011

(87) PCT Pub. No.: WO2010/083854
PCT Pub. Date: Jul. 29, 2010

(65) Prior Publication Data
US 2011/0317818 A1 Dec. 29, 2011

(51) Int. Cl.
*H01J 5/18* (2006.01)

(52) U.S. Cl.
USPC ..... 378/140

(58) Field of Classification Search
USPC ..... 378/140, 161
See application file for complete search history.

(56) References Cited

U.S. PATENT DOCUMENTS

| | | | | |
|---|---|---|---|---|
| 2,665,391 | A | 1/1954 | Bleeksma | |
| 5,159,621 | A | 10/1992 | Watanabe et al. | |
| 5,848,124 | A | 12/1998 | Inazuru | |
| 6,385,290 | B1 | 5/2002 | Kondo et al. | |
| 7,355,191 | B2 * | 4/2008 | Bykanov et al. | 250/504 R |
| 2008/0285717 | A1 | 11/2008 | Barschdorf et al. | |
| 2009/0141864 | A1 | 6/2009 | Hertz et al. | |

FOREIGN PATENT DOCUMENTS

| | | | |
|---|---|---|---|
| JP | S53-134675 | U | 10/1978 |
| JP | S54-9594 | A | 1/1979 |
| JP | S62-036549 | A | 2/1987 |

(Continued)

OTHER PUBLICATIONS

International Search Report (PCT/ISA/210) for PCT/EP2009/000481 dated Oct. 13, 2009.

(Continued)

*Primary Examiner* — Courtney Thomas
(74) *Attorney, Agent, or Firm* — Buchanan Ingersoll & Rooney PC

(57) ABSTRACT

A self-cleaning X-ray window arrangement is provided that includes a primary X-ray-transparent window element, separating an ambient pressure region from an intermediate region, and a secondary X-ray-transparent window element, separating the intermediate region from a reduced pressure region. A contaminant is expected to deposit on a side of the secondary element facing the reduced pressure region. A heat source is adapted to heat a portion of the secondary window element thereby evaporating contaminant. The secondary element shields the primary element from the reduced pressure region, in which contaminant is present, whereas the pressure-tight primary window element carries most of the differential pressure between the ambient pressure region and the reduced pressure region. Several features help to decrease the rate at which contaminant enters the intermediate region. By maintaining the pressure in the intermediate region close to the reduced pressure, the mechanical stress on the secondary window element can be limited as well as the exposure to harmful gases.

20 Claims, 3 Drawing Sheets

(56) References Cited

FOREIGN PATENT DOCUMENTS

| | | | |
|---|---|---|---|
| JP | H04-363700 | A | 12/1992 |
| JP | 07254493 | | 10/1995 |
| JP | H08-198687 | A | 8/1996 |
| JP | H09-509501 | A | 9/1997 |
| JP | 2000-088999 | A | 3/2000 |
| JP | 2007-533093 | A | 11/2007 |
| SE | 530 094 | C2 | 2/2008 |
| WO | 96/18477 | A1 | 6/1996 |
| WO | WO 2006/093780 | A2 | 9/2006 |
| WO | 2007133144 | A1 | 11/2007 |

OTHER PUBLICATIONS

First Office Action issued by Chinese Patent Office on Jun. 20, 2013, in corresponding Chinese Patent Application No. 200980155094.7 and English translation of Chinese Office Action (16 pages).

* cited by examiner

X-RAY WINDOW

TECHNICAL FIELD

The present invention generally relates to electron-impact X-ray sources. More particularly, the invention relates to an X-ray window for use in a device for X-ray generation having a liquid-jet anode.

BACKGROUND

X-ray sources having as anode a jet of liquid metal is one of the most recent technological paradigms in X-ray generation. Such sources are characterised by their excellent brightness, which brings benefits relating to exposure duration, spatial resolution and new imaging methods, such as phase-contrast imaging.

On the technological level, an X-ray source of this kind includes an electron source and a jet of liquid (preferably a liquid metal with low melting point, such as indium, tin, gallium, lead or bismuth, or an alloy thereof) provided inside a vacuum chamber. More precisely, the electron source may function by the principle of, e.g., cold-field emission, thermal-field emission and thermionic emission. Means for providing the liquid jet may include a heater and/or a cooler, a pressurising means (such as a mechanical pump or a source of chemically inert propellant gas), a nozzle and a receptacle to collect liquid (liquid dump) at the end of the jet. The portion of the liquid jet which is being hit by the electron beam during operation is referred to as the interaction region. The X-ray radiation generated by the interaction between the electron beam and the liquid jet leaves the vacuum chamber through a window. In available X-ray sources, the window consists of a framed thin foil of a suitable material. Requirements on the window material include high X-ray transparency (i.e., low atomic number) and sufficient mechanical strength to separate vacuum from the ambient pressure. Beryllium has widespread use in such windows.

During normal operation of the X-ray source, the window becomes gradually obscured by depositing debris. Not only does the average flux decrease due to absorption of X-rays in such deposited debris, but larger splashes will also manifest themselves as dark spots in the images caused by uneven illumination. The debris mainly consists of material from the liquid jet anode which is transported to the window in gaseous form or as splashes. Debris is chiefly produced by spraying effects at the jet nozzle (especially when it is switched on or off), in the region where the electron beam hits the liquid jet, and at the surface of the liquid contained in the receptacle at the end of the jet. Steps have been taken to reduce the production of debris, cf. granted patent SE 530 094, but there is still a discouraging positive correlation between the output X-ray power and the rate of debris production.

SUMMARY OF THE INVENTION

It is an object of the present invention to provide a liquid-jet X-ray source with an improved access to the x-ray anode as well as increased maintenance intervals. Liquid-jet X-ray sources generate debris—splashes, vapour and other types—which deposit on the output window. The rate of deposition depends, among other things, on the distance between the anode and the output window as well as the applied power. Indeed, many of those skilled in the art recognise the anode-to-window distance as a design dilemma as far as life-time is traded for distance. A short anode-to-window distance is attractive for flexible and efficient use of the generated X-ray radiation. To this end, there have been efforts in the art to locate the anode close to the output window of the device. In conventional solutions, however, there is no available method of cleaning the window from depositions without releasing the vacuum and disassembling the X-ray source. Hence, it is a particular object of the invention disclosed herein to mitigate the deterioration over time due to debris deposition which is accelerated by reducing the distance between the output window and the anode in a liquid-jet X-ray source.

The inventors have realised that the low pressure in the vacuum chamber (typically $10^{-7}$ bar) makes evaporation by heat an advantageous way of removing a contaminant from the output window. On the one hand, available window materials, particularly beryllium, perform poorly at high temperatures and tend to be chemically unstable. However, on the other hand, such known materials that do withstand heat and have an acceptable X-ray transparency often lack sufficient mechanical strength to act as a vacuum break. Some materials, especially carbon foil, will also oxidise when heated in the presence of atmospheric gases, notably oxygen.

These considerations have led the inventors to conceive a dual window configuration as set forth in appended claim 1.

Thus, in accordance with a first aspect of the invention, there is provided a self-cleaning X-ray window arrangement. The X-ray window arrangement includes a primary X-ray-transparent window element, separating an ambient pressure region from an intermediate region, and a secondary X-ray-transparent window element, separating the intermediate region from a reduced pressure region. A contaminant is expected to deposit on a side of the secondary window element which faces the reduced pressure region. The window arrangement further comprises a heat source adapted to heat at least a portion of the secondary window element for thereby evaporating any contaminant having deposited thereon. The heat source may be a dedicated heater or a nearby hot region of space from which enough heat is transmitted to the secondary window element for evaporation of contaminant to take place.

The secondary window element shields the primary window element, which is unsuitable for being cleaned by heating, from the reduced pressure region, in which contaminant is present. Several features of the invention help to decrease the rate at which contaminant enters the intermediate region; ideally, contaminant is prevented from entering this region. On the other hand, the pressure-tight primary window element carries most of the differential pressure between the ambient pressure region and the reduced pressure region. By maintaining the pressure in the intermediate region relatively close or equal to the reduced pressure, the mechanical stress on the secondary window element can be limited. This has the additional benefit of restricting the partial pressure of potentially harmful gases, particularly oxygen, which may otherwise damage the secondary window element at high temperatures.

A window arrangement according to the invention may be provided in the wall of a vacuum or near-vacuum chamber (reduced pressure region) of an X-ray source and allows generated X-rays to leave the chamber while preserving the necessary (near-)vacuum conditions. In the case of a liquid-metal-jet X-ray source, the contaminant may be metal debris from the anode. Even though debris accumulates on the secondary window element during normal operation of the X-ray source, the secondary window element can be conveniently cleaned according to the invention without disassembling the X-ray source or releasing the vacuum. Notably, removal of debris from secondary window element can take place even during normal operation of the X-ray source.

As an optional feature of the invention, the secondary window element—at least that side of the window element which faces the reduced pressure region—is electrically conducting. A window arrangement with this optional feature is particularly suitable for use in the housing of an electron-impact X-ray source. The secondary window element is likely to be bombarded by scattered electrons and there is consequently a risk of charge build-up. By providing a partially or completely conducting secondary window, any electrical charge can be drained from the window element.

The intermediate region and the reduced pressure may also be in at least partial communication, i.e., it may be possible for gas molecules to travel between these regions, so that any significant pressure difference will be avoided. This may be achieved by the provision of an aperture, such as a passage or slit, connecting the intermediate region and the reduced pressure region. If the aperture has low flow resistance (this depends on, e.g., its diameter, length and tortuosity), a pressure difference can be equalised very quickly; it may then be appropriate to say that the intermediate region and the reduced pressure region are in free communication and have the same pressure.

Further, the reduced pressure region and the intermediate region may be connected by a passage which is adapted to promote deposition of the contaminant when this is present in the passage in the form of vapour, suspended particles or suspended droplets. Thus, at least some of the contaminant entering the passage will never leave it, but remains immobilised after deposition by being bound to some portion, e.g., the inner wall, of the passage. By virtue of being a region that promotes deposition, the passage prevents contaminant from entering the intermediate region, where it might otherwise deposit on the surface of the primary window element from which it is cumbersome to remove the deposit. Features of the passage which stimulate deposition of contaminant may include:

- the passage is thin and/or elongated;
- the passage is ramified;
- the passage is tortuous (winding);
- the walls of the passage are maintained at a lower temperature than the reduced pressure region;
- the inside of the passage is rough;
- the inside of the passage is coated with a contaminant-adsorbing material; and/or
- a porous filter is provided in the passage;

The pressure in the intermediate region may be greater than the pressure in the reduced region during operation. This may be the case when there is no free communication between these regions, e.g., if the intermediate region is gas-tightly sealed or has a narrow entry passage. An advantage of sealing the intermediate region gas-tightly and/or having a higher pressure in the intermediate region compared with the reduced pressure region is that it is very difficult for any contaminant to enter the intermediate region from the reduced pressure region.

Alternatively, the pressures in the intermediate region and the reduced pressure region may be essentially equal. This may be the case if the two regions are in partial communication or free communication with one another. An advantage of this is that the mechanical stress on the secondary window element will be very low, at least in the transversal direction (normal to the surface), because the window does not carry any significant pressure difference.

As an attractive optional feature of the invention, the secondary window element is preferably non-rigidly secured. An advantage is that the window is allowed to expand and contract as its temperature changes. The linear size change, in absolute terms, will be comparatively larger in the tangential direction (along the surface) than in the transversal direction; if the secondary window element had been completely rigidly secured, the tangential mechanical stress would have been larger than the transversal. Hence, the secondary window element may advantageously be non-rigidly secured in the tangential direction.

In some embodiments of the invention (which may or may not include the optional features set forth above), at least a portion of the secondary window element is made from glassy carbon foil having a thickness of less than 200 micrometer, preferably less than 100 micrometer, and most preferably less than 60 micrometer. Glassy carbon, which is sometimes referred to as amorphous or vitreous carbon, is a material which meritoriously fulfils the requirements on the secondary window. As discussed above, these requirements include heat durability and X-ray transparency at useful thickness values.

If the liquid jet comprises a low-vapour-pressure material (such as e.g. molten metals and alloys), the heat source is preferably operated in such a manner that at least a portion of the secondary window element is maintained at a temperature of at least 500 degrees Celsius. Suitably, a region around the intersection of the chief optical ray of the X-ray source, through which the majority of the X-ray radiation is expected to pass, is kept at such temperatures. The (portion of the) secondary window element may be kept at a constant temperature above 500 degrees or may have a time-varying temperature which does not go below 500 degrees. It should be understood, however, that heating may also be applied intermittently in case continuous self-cleaning of the window is not required. It has been found empirically that a temperature of at least 500 degrees Celsius is appropriate for evaporating metal debris at a rate sufficient to counteract the debris deposition. In circumstances where debris accumulates at a high rate, the secondary window element may need to be maintained at a higher temperature to accelerate the evaporation process. The skilled person will find suitable operational temperatures for various operating parameters, anode materials, anode-to-window distances, etc. by routine experimentation once this specification has been read and understood.

Ohmic heat sources are particularly advantageous. The heat source may be a heat-dissipating electric element in thermal contact with the secondary window element. Preferably, however, the secondary window element is heated directly by a flow of electricity between two regions of the window element. In each of said regions, which may be located on the edge or in the interior of the window element, an electric contacting member may be provided. The secondary window element may have equal resistance per unit area throughout. Most preferably, however, a portion around the intersection of the chief optical ray of the X-ray source is adapted to dissipate a comparatively higher electric power per unit area; this can be achieved, e.g., using different materials and/or varying the thickness of the window element in this portion. It is advantageous to only heat that portion of the secondary window element through which the generated X-ray beam passes because, firstly, prolonged heating may accelerate ageing of the secondary window element and, secondly, this alleviates requirements of securing the window element in a heat-insulating manner.

Heat sources which are also useful in the window arrangement include an infrared source, a microwave source, a laser or an electron-beam source. The heat source may also be a combination. An advantage of each of these heat sources is that they transmit energy for heating the secondary window element in a contactless manner. The electron-beam source may be the same electron source as is used for X-ray production; suitably, a portion of the emitted electron beam is then deflected to hit the secondary window element directly. It is appreciated that the heat sources may also include, as a particular case, the interaction region itself, which emits both infrared radiation and scattered electrons.

Optionally, the secondary window element may be secured in the following fashion. One or more receptacles containing electrically conducting liquid is provided around the edge of the secondary window element. In the wall of each receptacle, one or more slits are provided having such dimensions that, on the one hand, surface tension of the conducting liquid is sufficient to prevent the liquid from escaping from the receptacle and, on the other hand, the secondary window element when held in such slit is not clamped but can expand and contract in the tangential direction. Another preferable embodiment includes securing two opposing portions of the edge of the secondary window element by inserting each edge through a slit into a respective reservoir, as detailed above. By applying different electric potentials to the reservoirs, direct ohmic heating of the window element may then be effectuated.

In accordance with a second aspect of the present invention, there is provided an X-ray source comprising a self-cleaning X-ray window arrangement according to the above.

In a particular embodiment of the X-ray source, the heat source of the X-ray window arrangement is controlled on the basis of operational data for the electron source and the liquid-jet target. For instance, in an X-ray source for which the rate of debris accumulation (e.g., measured as mass of deposited matter per unit time) is known to increase with the intensity of the electron beam hitting the anode, it may be advantageous to regulate the power of the heat source in accordance with the intensity of the electron beam, so that a suitable amount of energy for evaporation is supplied at every instant.

These and other aspects of the invention will be apparent from and elucidated with reference to the embodiments described hereinafter.

All terms used herein are to be interpreted according to their ordinary meaning in the technical field, unless explicitly defined otherwise herein. All references to "a/an/the [element, device, component, means, step, etc.]" are to be interpreted openly as referring to at least one instance of the element, device, component, means, step, etc., unless explicitly stated otherwise.

BRIEF DESCRIPTION OF THE FIGURES

The present invention will now be further elucidated with reference to the accompanying drawings, on which.

DETAILED DESCRIPTIONS OF EMBODIMENTS OF THE INVENTION

Some embodiments of the invention are shown on the drawings and are described in this section. The invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Furthermore, like numbers refer to like elements throughout.

Figure 1:
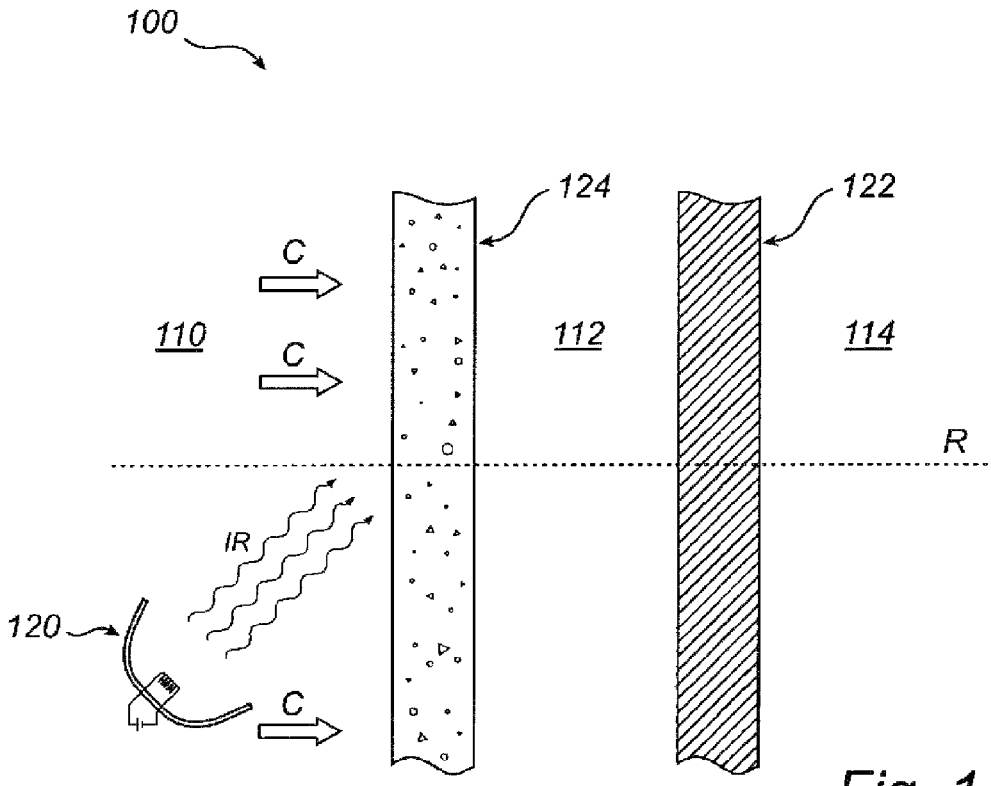
FIG. 1 is a diagrammatic cross-sectional view of a central portion of an X-ray window arrangement according to the invention.

FIG. 1 is a diagrammatic cross-sectional view of a central portion of an X-ray window arrangement 100 according to a first embodiment of the invention. An intended use of the window arrangement 100 is the provision of a vacuum-proof X-ray aperture in the housing of an X-ray source. The chief optical ray direction R of the X-ray source is indicated by a dashed horizontal line on the drawing. The window arrangement 100 separates a reduced pressure region 110 (inside of the housing containing means for X-ray generation) and an ambient pressure region 114 (the environment). In this embodiment, the window arrangement 110 comprises two substantially parallel window elements: a primary window element 122 and a secondary window element 124. The primary and secondary window elements enclose an intermediate region 112. A contaminant C is expected to deposit on the side of the secondary window element 124 facing the reduced pressure region. The contaminant C may reach the secondary window element 124 in the form of vapour, suspended particles or droplets, or as splashes. Further, a heat source 120 is adapted to emit a beam of infrared (IR) light towards a region of the secondary window element around the chief optical ray direction R. In the exemplary embodiment shown in FIG. 1, the heat source comprises an electric resistor, which is operable to emit IR light, which is arranged near the focal point of a parabolic mirror. Hence, the IR beam emitted by the heat source 120 is essentially collimated, so that the heated region of the secondary window element 124 receives a heat power per unit area which is approximately constant. It is noted that the heat source 120 is not arranged on the chief ray axis R, but is slightly displaced in order to not obstruct the path of the outward X-ray radiation. The placement of the heat source should be chosen with similar consideration in any embodiment of the invention.

Figure 2:
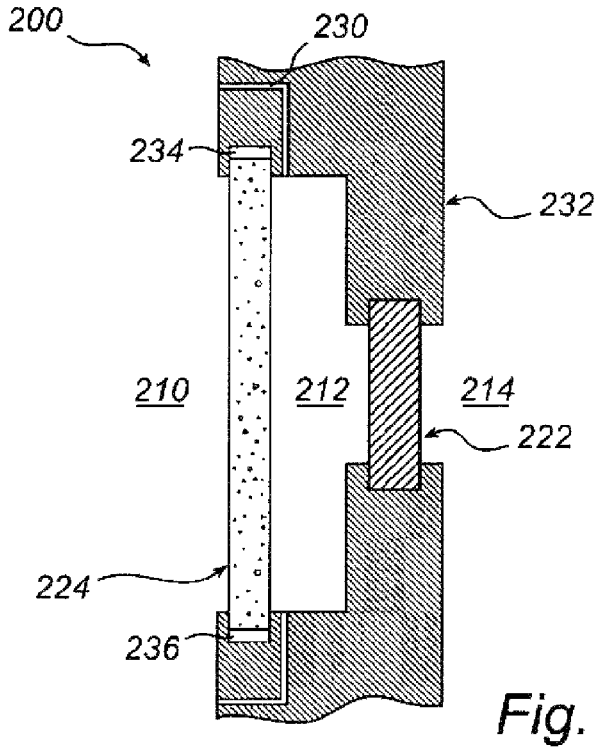
FIG. 2 is a diagrammatic cross-sectional view of an X-ray window arrangement in accordance with an embodiment of the invention wherein the intermediate region and the reduced pressure region are in free communication.

FIG. 2 is a diagrammatic cross-sectional view of an X-ray window arrangement 200 in accordance with a second embodiment of the invention. As in the first embodiment, a relatively smaller, vacuum-tight primary window element 222 and a relatively larger, heat-resistant secondary window element 224 separate three regions of space: a reduced pressure region 210, an intermediate region 212 and an ambient region 214. As discussed above, suitable materials for the primary window element 222 include beryllium, and, for the secondary window element 224, glassy carbon foil; both materials are X-ray transparent at useful thickness values. The window elements 222, 224 are secured to a gas-tight housing 232. To allow for thermal expansion, the securing features a clearance 234, 236 at each edge of the secondary window element 224; similar clearances may be provided at those edges of the secondary window element 224 which lie outside the plane of the drawing.

The window arrangement 200 further comprises a heat source (not shown). It is noted that each of the clearances 234, 236 also acts as a heat insulator between the secondary window element 224 and the housing 232. Additionally, the portion of the housing 232 which surrounds the window arrangement 200 may consist of a material with low thermal conductivity. It is advantageous to reduce the heat flux away from the secondary window element 224, because less energy needs to be supplied in order to keep the window element 224 (or a portion thereof) at the desired temperature. This also reduces the need for cooling of the X-ray source in the region where the window arrangement 200 is provided.

A passage 230 connects the reduced pressure region 210 and the intermediate region 212, which are thus in free communication as far as gas molecules are concerned. Thanks to the shape, diameter and length of the passage 230, it is difficult for contaminants to reach the primary window element 222. Direct impact of debris from the reduced pressure region 210 onto the primary window element 222 is apparently not possible. As regards vapour and suspended contaminant, it has been found experimentally that the deposition rate falls off as the inverse square of the distance from the source, at least along a line of free sight. The rate of deposition may also be drastitally decreased by introducing bends and other obstacles. Hence, since the path from any contaminant source present in the reduced pressure region 210 to the primary window element 222 is not direct and much longer than the path to the secondary window element 224, the deposition rate on the secondary window element is profoundly reduced. It is noted that this beneficial difference in path length can be further increased by enlarging the secondary window element 224. Such enlargement is not likely to increase the mechanical stress on the secondary window element 224, for it does not carry a pressure difference.

An alternative way of increasing the path-length difference in the window arrangement 200 would be to replace the passage 230 by two or more thinner passages between the reduced pressure region 210 and the intermediate region 212. If each passage is made thinner, thereby increasing the area-to-volume ratio, an additional hindrance to the transport of contaminant is created in so far as deposition on the inner walls of the passage is stimulated. Another way of promoting deposition on the inner walls of the passage 230 would be to locate the passage so that it is separated by a sufficient distance from the heated secondary window element 224, whereby the inner walls of the passage 230 are kept at a comparatively lower temperature. Yet another way of making transport of contaminant into the intermediate region 212 more difficult is to roughen the inner surface of the passage 230 or to coat it with a substance on which the contaminant is prone to deposit.

Figure 3:
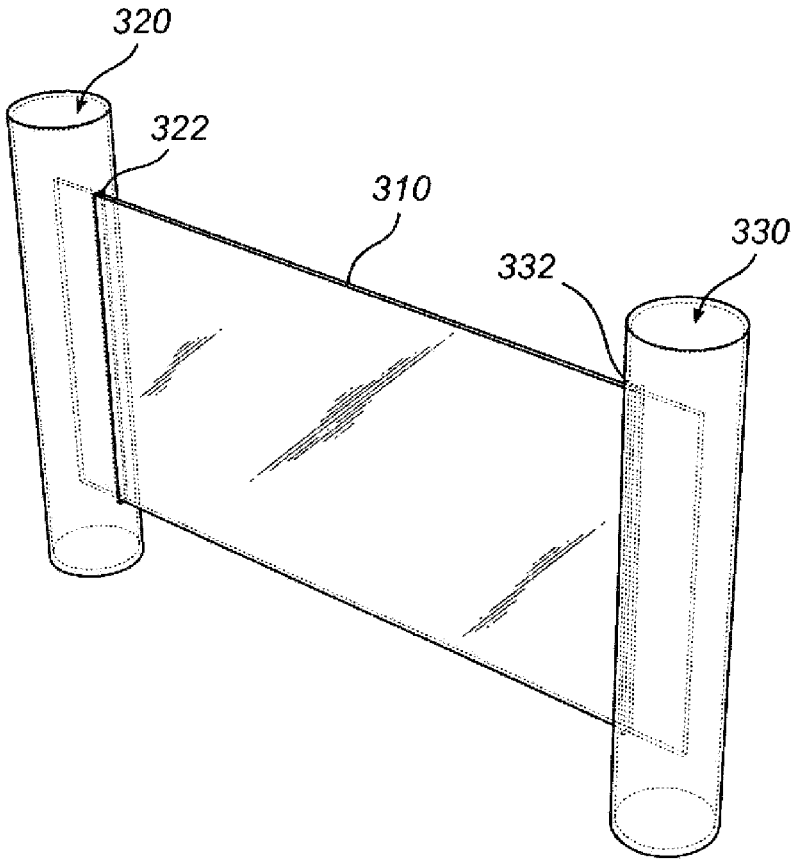
FIG. 3 is a perspective view illustrating a securing of the secondary window element in accordance with an aspect of the invention.

FIG. 3 is a perspective view illustrating an advantageous securing of a secondary window element 310 in an X-ray window arrangement in accordance with the invention. Two edges of the secondary window element 310 are inserted into respective slits 322, 332 provided in outer walls of reservoirs 320, 330. It is appreciated that the slits 322, 332 do not exert any significant friction force on the secondary window element 310, but the window element can extend and contract, at least tangentially, in response to temperature variations without changing shape. Some electrically conducting liquid, such as molten metal, is contained in the reservoirs 320, 330 and is retained therein even at the slits 322, 332 by virtue of surface tension. To achieve this, the width of the slits 322, 332 is limited. The embodiment shown in FIG. 3 is particularly suitable for using direct ohmic heating as a heat source for evaporating a contaminant. The respective edges of the secondary window element 310 are then connected to different electric potentials by applying a voltage source, via suitable contacting means, to the liquid contained in each of the reservoirs 320, 330. To drain electric charge off the window, one of the reservoirs is grounded (not shown).

As a simpler alternative to the above, it is also envisaged to use the securing shown in FIG. 3 for only one edge of a secondary window element. Even though its other end is fixed—e.g., by a combined clamping and electrical contacting means—the secondary window element can still undergo thermal expansion and contraction.

As another alternative, more than two sides may be secured in the disclosed way. In particular, the entire boundary of the secondary window element may be secured by insertion into slits in reservoirs containing electrically conducting liquid; alternatively, the secondary window element is inserted (framed) into one slit receiving the entire periphery of the window element, the slit being provided in a single reservoir. Since the secondary window element can then be gas-tightly secured to the housing, this is an attractive feature for embodiments in which it is important to limit the transport of matter between the intermediate region and the reduced pressure region. If additionally it is desirable to heat the secondary window element by direct ohmic heating, plural reservoirs which are electrically insulated mutually may be provided. This way, different electric potentials can be applied to different edge segments of the window element. As pointed out above, at least one portion of the periphery of the window element should be earthed, so that electrons can be drained.

Figure 4:
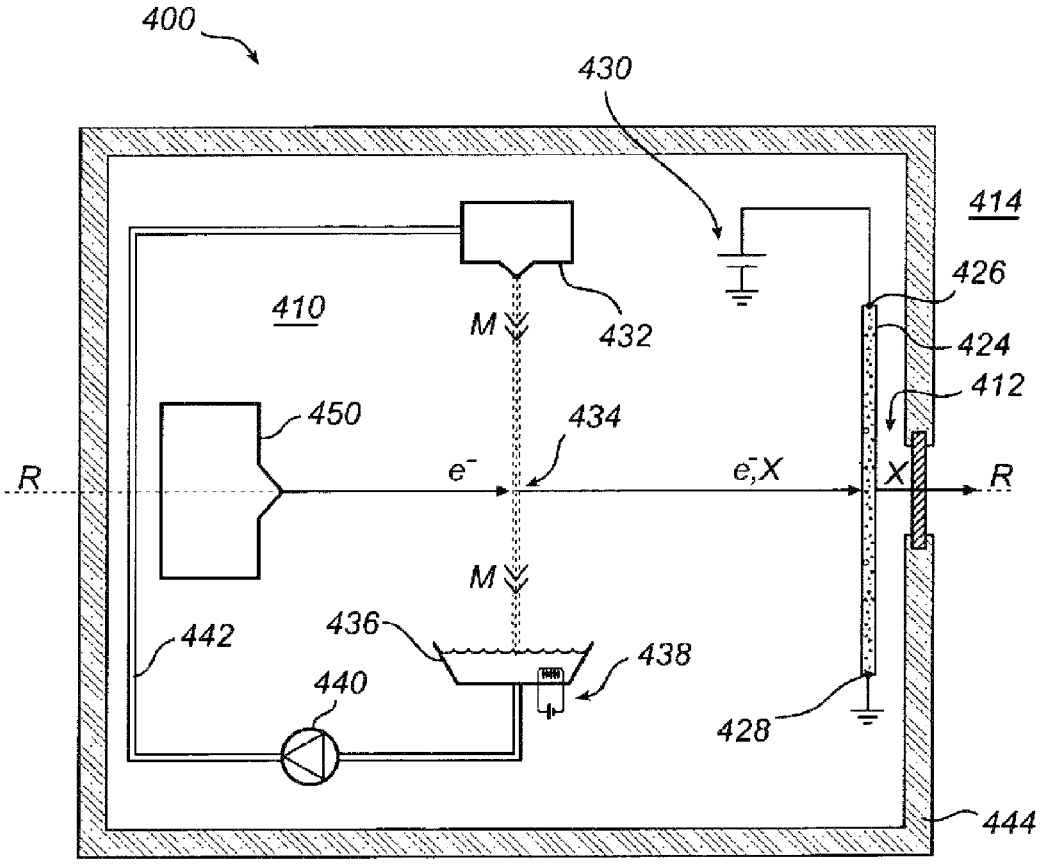
FIG. 4 is a diagrammatic cross-sectional partial view, seen in the plane of the electron beam and the liquid jet, of an X-ray source including an X-ray window according to the invention.

FIG. 4 is a diagrammatic cross-sectional partial view of a liquid-metal-jet X-ray source 400 including an X-ray window arrangement according to an embodiment of the invention. The plane of the drawing contains the electron beam $e^-$ and the liquid-metal jet M. A vacuum-tight (gas-tight) housing 444 and a primary window element 422 enclose a reduced pressure region 410, which during operation of the X-ray source 400 is at vacuum or near-vacuum pressure, such as between $10^{-9}$ and $10^{-6}$ bar. Means for evacuating air molecules from the reduced pressure region 410 have been omitted from the drawing for simplicity. The liquid-metal jet M, which functions as an anode of the X-ray source, is continuously ejected from a nozzle 432 during operation, and is collected by a receptacle 436. An optional heating means 438 is provided in the receptacle and supplies enough heat to maintain the metal above its melting point. In other embodiments, wherein more excess heat is generated, it may instead be necessary to cool the liquid metal. Moreover, in cases where the heat production varies over time, a general-purpose temperature control means may be provided in connection with the receptacle 436. A pump 440 re-circulates liquid metal from the receptacle 436 to the nozzle 432 via a duct 442. An electron source 450 emits a beam of electrons $e^-$ along the chief ray direction towards the liquid-metal jet M, and intersects it at an interaction region 434. The interaction region 434 emits X-ray radiation. The angular radiation pattern varies in function of several parameters, such as the respective width and shape of the electron beam and the liquid-metal jet. The embodiment shown in FIG. 4 has been conceived under the assumption that the chief ray direction has the strongest emitted X-ray intensity; therefore, the X-ray window arrangement is essentially aligned with the chief ray direction. Downstream of the interaction region 434, there may be transport of electrons in addition to X rays.

Besides the primary window element 422, the X-ray window arrangement 400 comprises a relatively larger secondary window element 424. The secondary window element 424 is arranged so closely to the primary window element 422 that diffusion of contaminant in the form of suspended particles, droplets or vapour is hampered to a great extent. To achieve a twofold advantage, however, the secondary window element 424 is not fitted tightly against the housing 444 or the primary window element 422. Firstly, pressure equalisation is facilitated, and secondly, the heat flux off the secondary window element 424 is restricted, thereby limiting the amount of heat needed to be supplied per unit time. The secondary window element 424 comprises electrical connection points 426, 428 located on opposite edges. Earth potential is applied to one connection point 428, whereas an electric voltage source 430 applies a non-earth potential to the other connection point 426. Since the secondary window element 424 is suitably manufactured from an electrically conducting but resistive material, an electric current will flow in the vertical direction of the drawing, thereby heating the window element 424. Likewise, any electrons hitting the secondary window element 424 from the upstream direction will be transported off the window element 424, so that electric charge does not accumulate. Along the chief ray axis, electrons are essentially absent downstream of the secondary window element and, a fortiori, downstream of the primary window element. Hence, as an output of the X-ray source 400, a beam of X-ray radiation is emitted from the exterior side of the primary window element 422.

The voltage source 430 may supply constant voltage, constant current or be regulated as a function of some quantity associated with the generation of X-ray radiation. For instance, the voltage may vary in accordance with changes in the electron beam intensity, which is related to the rate of debris production. An advantageous way of controlling the voltage source 430 is to maintain the temperature of some point on the secondary window element 424 at a constant temperature or, allowing a tolerance, within a temperature range. A suitable temperature may be such that the vapour pressure of the metal used in the liquid-metal jet is so high, in relation to the operational vacuum or near-vacuum pressure, that evaporation of the metal will take place at a rate considered satisfactory by a user of the X-ray source. For instance, in an equipment where metal splashes on the secondary window element 424 occur frequently and the requirement for image quality is high, it may be motivated to heat the secondary window element to a relatively high temperature even though this is likely to accelerate ageing of the material of the secondary window element 424. In principle, the vapour pressure (as a function of temperature) of whatever material is used in the liquid jet is a key parameter in determining a suitable temperature at which the secondary window element 424 should be maintained: low temperatures are sufficient to evaporate liquid gases; oils are suitably evaporated at intermediate temperatures, such as 200 to 300 degrees Celsius; metals with high melting points require high temperatures, such as approximately 500 degrees Celsius. In the special case of using a liquid (solvent) containing a dissolved substance, the vapour pressure of the expected deposit on the secondary window element is a significant quantity, so that the properties of the solvent are not very important in this case. As a final remark on heat sources, it is noted that the interaction region 434 may transmit an appreciable amount of heat per unit time to the secondary window element 424, especially if their distance is moderate. Thus, the heat source of the embodiment shown in FIG. 4 is both the various means involved in the ohmic heating and the interaction region 424.

Self-cleaning X-ray windows according to embodiments of the present invention may not only be used in X-ray sources having the same construction as the source 400 depicted in FIG. 4. For instance, the electron beam hitting the liquid-jet target and the generated X-ray beam are not necessarily parallel and collinear, but can make an arbitrary angle. In one embodiment, the angle is 90 degrees. Letting the X-ray beam leave the X-ray source at a non-zero angle with the electron beam generating can be advantageous since the portion of the electron beam which does not interact with the liquid-jet target, but passes beyond it, is then not aimed at the X-ray window arrangement. (This portion may be of considerable magnitude in embodiments wherein the electron beam is purposefully aimed at an edge of the liquid jet.) Hence, essentially the electron beam and the X-ray beam never coincide in space.

Alternatively, the invention can be embodied as a liquid-jet X-ray source having a vacuum-tight housing divided into two chambers. The electron source and the liquid target are located in a main chamber (reduced pressure region), which is optically connected to a second chamber (intermediate region) by means of a secondary window element having similar characteristics as secondary window elements discussed above. X-ray radiation generated in the main chamber may enter the second chamber via the secondary window element and subsequently reach the ambience via a primary window element, which is arranged in the housing and substantially aligned with the secondary window element. The chambers are in free communication via a passage extending outside the housing. The passage is connected to each of the chambers via gas-tight connecting means in the housing. Advantageously, the passage is at lower temperature than the chambers and may have such length that sufficient deposition occurs inside. Further advantageously, the passage can be made replaceable, so that cumbersome removal of debris obstructing the passage is avoided.

While the invention has been illustrated and described in detail in the drawings and foregoing description, such illustration and description are to be considered illustrative or exemplary and not restrictive; the invention is not limited to the disclosed embodiments. For instance, liquid-jet materials may be selected from a wide range of materials, some of which may require making specific adjustments and adaptations to the window arrangement. It is understood that some components that are included in the disclosed embodiments are optional. Notably, a dedicated heat source associated with the X-ray window arrangement may prove superfluous if significant heat power is dissipated in the interaction region. Actually, if the heat power is very high, cooling means may be required instead to preserve the materials constituting the components of the X-ray source and/or the window arrangement.

Other variations to the disclosed embodiments can be understood and effected by those skilled in the art in practicing the claimed invention, from a study of the drawings, the disclosure and the appended claims. The mere fact that certain measures are recited in mutually different dependent claims does not indicate that a combination of these measures cannot be used to advantage. Any reference signs in the claims should not be construed as limiting the scope.

The invention claimed is:

1. A self-cleaning X-ray window arrangement for separating an ambient pressure region from a reduced pressure region and allowing X-rays to leave the reduced pressure region, the window arrangement comprising:

a primary window element separating the ambient pressure region from an intermediate region;

a secondary window element separating the intermediate region from the reduced pressure region, which secondary window element comprises a side for receiving a contaminant depositing thereon, said side facing the reduced pressure region; and a heat source adapted to heat at least a portion of said secondary window element thereby evaporating contaminant having deposited thereon.

2. The self-cleaning X-ray window arrangement according to claim 1, wherein that side of the secondary window element which faces the reduced pressure region is electrically conducting.

3. The self-cleaning X-ray window arrangement according to claim 1, wherein the intermediate region and the reduced pressure region are in at least partial communication.

4. The self-cleaning X-ray window arrangement according to claim 3, further comprising a pressure-equalising passage connecting the intermediate region and the reduced pressure region, which passage is adapted to cause said contaminant to deposit, so that the contaminant is prevented from reaching said intermediate region.

5. The self-cleaning X-ray window arrangement according to claim 1, further comprising a closed intermediate region wherein the pressure in the intermediate region is greater than the reduced pressure.

6. The self-cleaning X-ray window arrangement according to claim 3, wherein the pressure in the intermediate region is essentially equal to the reduced pressure.

7. The self-cleaning X-ray window arrangement according to claim 1, wherein said secondary window element is non-rigidly secured, to allow for thermal expansion.

8. The self-cleaning X-ray window arrangement according to claim 1, wherein at least a portion of said second window element consists of glassy carbon foil having a thickness of less than 200 micrometers.

9. The self-cleaning X-ray window arrangement according to claim 1, wherein the heat source is operable to maintain said secondary window element at a temperature of at least 500 degrees Celsius.

10. The self-cleaning X-ray window arrangement according to claim 1, wherein the heat source comprises means for applying an electric voltage between regions in an electrically conducting portion of said secondary window element for effecting ohmic heating thereof.

11. The self-cleaning X-ray window arrangement according to claim 1, wherein said heat source comprises one or more of:

an infrared source;

a microwave source;

a laser; and an electron-beam source.

12. The self-cleaning X-ray window arrangement according to claim 10, further comprising a reservoir having at least one slit and containing electronically conducting fluid, wherein at least a portion of the boundary of said secondary window element is secured by being inserted into said at least one slit.

13. The self-cleaning X-ray window arrangement according to claim 12, wherein two opposite portions of the boundary of the secondary window element are secured.

14. An X-ray source comprising:

a gas-tight housing;

an electron source provided inside the housing;

a liquid-jet electron target provided inside the housing; and a self-cleaning X-ray window arrangement according to claim 1 provided in an outer wall of said housing.

15. The X-ray source according to claim 14, further comprising a controller for controlling the heat source of the self-cleaning X-ray window arrangement in accordance with an intensity of the electron source.

16. The self-cleaning X-ray window arrangement according to claim 2, wherein the intermediate region and the reduced pressure region are in at least partial communication.

17. The self-cleaning X-ray window arrangement according to claim 4, wherein the pressure in the intermediate region is essentially equal to the reduced pressure.

18. The self-cleaning X-ray window arrangement according to claim 1, wherein at least a portion of said second window element consists of glassy carbon foil having a thickness of less than 100 micrometers.

19. The self-cleaning X-ray window arrangement according to claim 1, wherein at least a portion of said second window element consists of glassy carbon foil having a thickness of less than 60 micrometers.

20. The self-cleaning X-ray window arrangement according to claim 2, wherein said heat source comprises one or more of:

an infrared source;

a microwave source;

a laser; and an electron-beam source.

* * * * *